United States Patent [19]

Vukovic

[11] Patent Number: 4,958,549

[45] Date of Patent: Sep. 25, 1990

[54] PEDAL MECHANISM FOR A BASS DRUM

[76] Inventor: Vuk Vukovic, 142 Inchmery Rd., Catford, London SE6, England

[21] Appl. No.: 380,775

[22] Filed: Jul. 18, 1989

Related U.S. Application Data

[63] Continuation of Ser. No. 189,465, May 2, 1988, abandoned.

[30] Foreign Application Priority Data

May 15, 1987 [GB] United Kingdom ..... 8711483

[51] Int. Cl.[5] ..... G10D 13/04

[52] U.S. Cl. ..... 84/422.1

[58] Field of Search ..... 84/422.1, 422.2, 422.3

[56] References Cited

U.S. PATENT DOCUMENTS

| | | | |
|---|---|---|---|
| 1,508,390 | 9/1924 | Gladstone et al. | 84/422.2 |
| 1,769,712 | 7/1930 | Pignocco | 84/422.1 |
| 2,484,302 | 10/1949 | Laverents | 84/422.1 |
| 2,484,936 | 10/1949 | Dezso | 84/422.3 |
| 2,581,515 | 1/1952 | Christian | 84/422.1 |
| 3,618,441 | 11/1971 | Fearns | 84/422.1 |
| 3,677,128 | 7/1972 | Simpson | 84/422.1 |
| 3,988,957 | 11/1976 | Escamilla | 84/422.1 |
| 4,188,853 | 2/1980 | Bills | 84/422.1 |
| 4,262,576 | 4/1981 | Gorsky et al. | 84/422.1 |

FOREIGN PATENT DOCUMENTS

| | | | |
|---|---|---|---|
| 2061077 | 7/1972 | Fed. Rep. of Germany . | |
| 625874 | 7/1949 | United Kingdom . | |
| 2146162 | 4/1985 | United Kingdom . | |
| 2172137 | 9/1986 | United Kingdom | 84/422.1 |

*Primary Examiner*—Brian W. Brown

[57] ABSTRACT

A pedal mechanism for a bass drum, including a pivoted primary platform connected to a beater ball so that, when the primary platform is depressed, the beater ball moves to contact a drum; and a resiliently mounted secondary platform in operative contact with the primary platform, the arrangement being such that, in use, the toe of the drummer depresses the primary platform directly and the heel of the drummer depresses the primary platform through the secondary platform.

15 Claims, 3 Drawing Sheets

PEDAL MECHANISM FOR A BASS DRUM

This is a continuation of co-pending application Ser. No. 189,465 filed on May 2, 1988 now abandoned.

INTRODUCTION

This invention relates to a pedal mechanism for a bass drum.

The conventional pedal mechanism for a bass drum includes a platform on which the foot of the drummer rests, this platform being pivoted at or near to its rear end and connected at its forward end through a linkage arrangement to a beater ball. To operate the pedal mechanism, the drummer rotates the platform about its pivot using the sole of his foot. The mechanism is spring returned so that, by intermittent pressure with the sole of his foot, the drummer can maintain a beat.

Some types of modern music demand that the beat of the bass drum be very fast and this can, to some extent, be met by the skill of the drummer in operating conventional pedal mechanisms but there is a limit to the speed with which the drum can be beaten even by the most skilful of drummers.

OBJECT OF THE INVENTION

It is the main object of this invention to provide a pedal mechanism for a bass drum which will enable the drummer to beat the drum at a fast rate and with more facility than has previously been possible.

STATEMENTS OF INVENTION

According to the present invention there is provided a pedal mechanism for a bass drum, including a pivoted primary platform connected to a beater ball so that, when the primary platform is depressed, the beater ball moves to contact a drum; and a resiliently mounted secondary platform in operative contact with the primary platform, the arrangement being such that, in use, the toe of the drummer depresses the primary platform directly and the heel of the drummer depresses the primary platform through the secondary platform.

The secondary platform may be pivotally mounted at one end to the primary platform and the resilient mounting of the secondary platform may be a spring between the primary and secondary platforms.

Alternatively, the secondary platform may be pivotally mounted at one end remote from the primary platform and its other end contact the primary platform.

DRAWINGS

SPECIFIC DESCRIPTION

Figure 1:
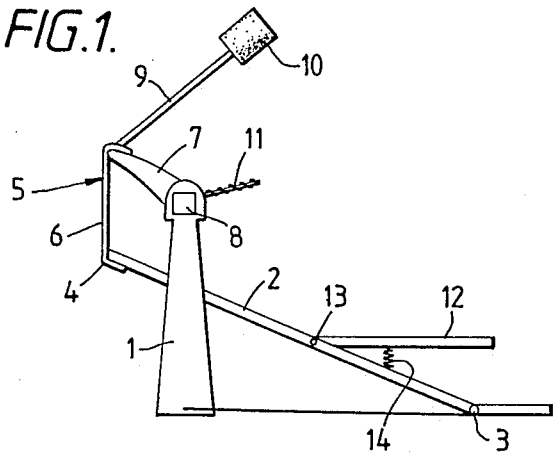
FIG. 1 is a diagrammatic side view of a pedal mechanism in accordance with the invention in one position.

Referring first to FIGS. 1 to 4, a pedal mechanism for a bass drum includes a stand 1, a primary platform 2 pivoted at one end at 3 and having connected at the other end at 4 a linkage 5 which includes a strap 6, an arm 7 mounted on stand 1 for rotation about pivot 8 and a rod 9. At the outer end of rod 9 is a beater ball 10. The beater ball 10 is loaded by spring 11 to the position shown in FIG. 1.

All this is conventional pedal mechanism which is operated by the drummer resting his foot on the platform 2 and depressing the platform 2 using the sole of his foot.

The invention provides a secondary platform 12, in this embodiment pivotally connected at 13 to primary platform 2, which is resiliently mounted by spring 14 to form an angle with the primary platform 2. Conveniently, in the rest position as shown in FIG. 1, the secondary platform will be substantially horizontal.

One particular way of designing the primary and secondary platforms is illustrated, by way of example only, in FIGS. 5 to 8 in which the primary platform 2 has a recess 15 with a cross bar 16 and an indent 17 and two slots 18 and 19. The secondary platform 12 has two arms 20 and 21 with holes 22, 23 which received a pivot rod 24 (see FIG. 8) passing through holes 22, 23 and through holes 25, 26 and 27 in primary platform 2. This arrangement enables the secondary platform 12 to pivot about rod 24 in relation to primary platform 2. A slot 28in secondary platform 12 receives spring 14 one end of which is located in indent 17.

The primary platform 2 is provided with further pivot holes 29, 30 which receive a pivot rod (not shown) to enable the primary platform to rotate about pivot 3.

Referring again to FIGS. 1 to 4, in use, the foot of the drummer rests with his sole on primary platform 2 and his heel on secondary platform 12. At rest, the position will be as in FIG. 1.

Figure 2:
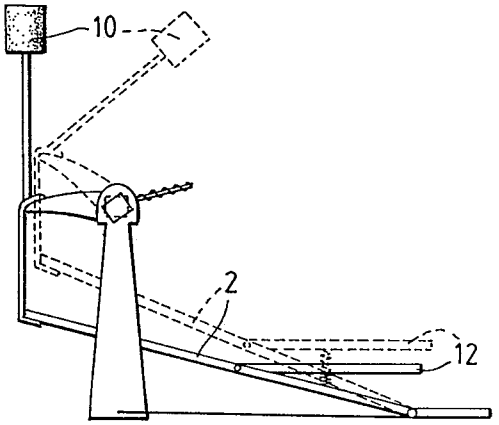
FIG. 2 is a view similar to FIG. 1 with the mechanism in a second position.
Figure 3:
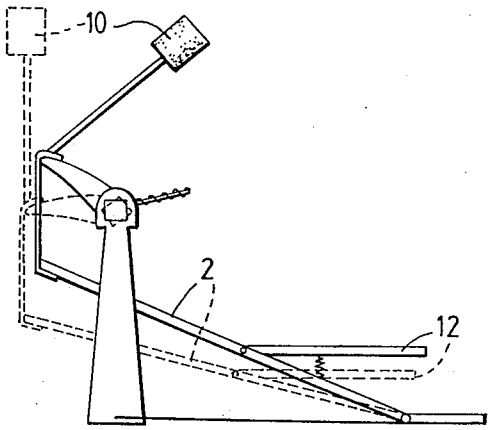
FIG. 3 is a view similar to FIG. 1 with the mechanism in a third position.

Depression of the heel of the drummer will bring about the position of FIG. 2 in which the primary platform has been rotated about pivot 3 by the force exerted by the heel of the drummer through the secondary platform 12 against the reaction of spring 14. It will be noted that the angle between the primary and secondary platforms has become smaller with the secondary platform remaining substantially horizontal although this may not occur in practice. Depression of the primary platform through the secondary platform in this way will move the beater ball against the drum.

Release of the heel pressure by the drummer will cause the springs 11 and 14 to return the primary and secondary platforms to their original rest positions with the beater ball away from the drum.

Figure 4:
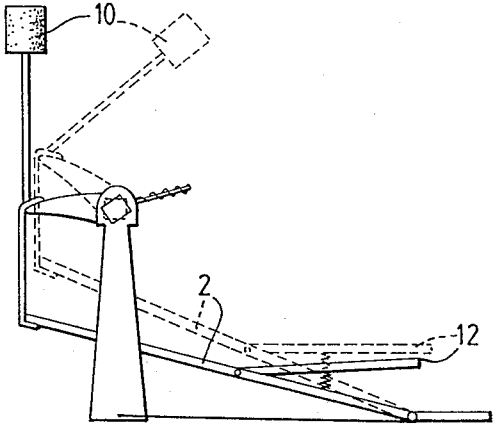
FIG. 4 is a view similar to FIG. 1 with the mechanism in a fourth position.
Figure 5:
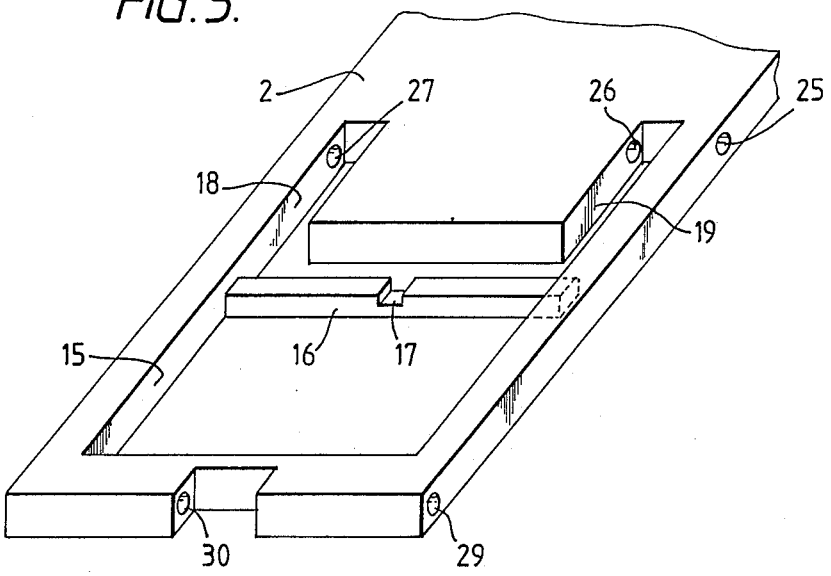
FIG. 5 is a fragmentary perspective view of a primary platform.
Figure 6:
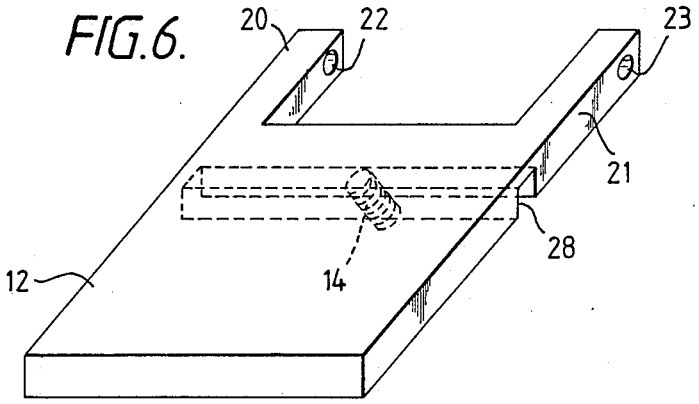
FIG. 6 is a perspective view of a secondary platform.
Figure 7:
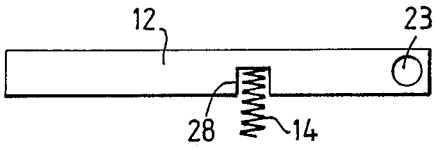
FIG. 7 is a side view of FIG. 6.
Figure 8:
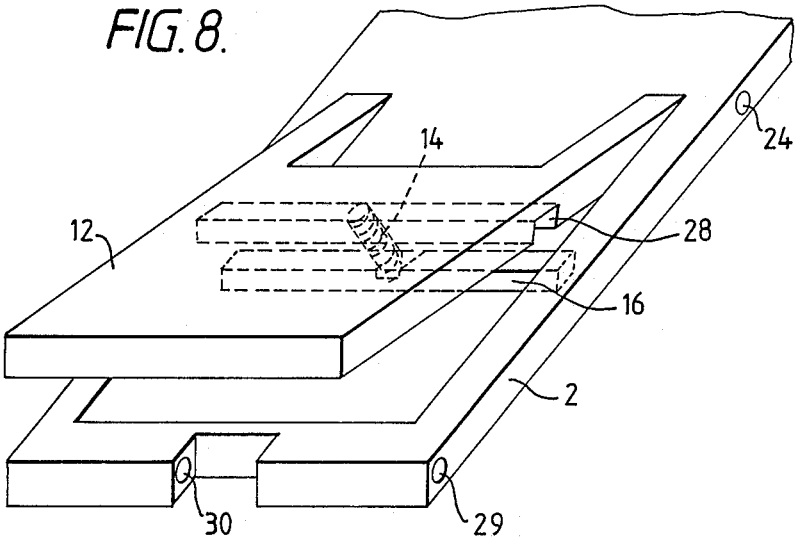
FIG. 8 is a fragmentary perspective view of the assembled primary and secondary platforms of FIGS. 5 to 7.

Downward pressure by the drummer with the sole of his foot on the primary platform will cause the position to change to that shown in FIG. 4 in which the beater ball again strikes the drum and the secondary platform remains in the same angular position relative to the primary platform. Release of the sole pressure will again return the mechanism to the position of FIG. 1.

It will be appreciated by a person skilled in the art that the mechanism of the invention enables a drummer to beat at a much faster rate than hitherto by virtue of using alternately his heel and toe. Also, the provision of resilient means such as springs cushions any jarring which may be felt. The tension on the springs may be adjustable.

Figure 9:
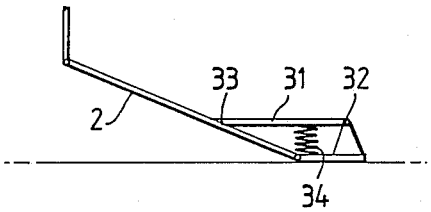
FIG. 9 is a diagrammatic side view of a further mechanism in accordance with the invention.

In FIG. 9 an alternative mechanism is shown in that a secondary platform 31 is pivoted at a remote point 32 from primary platform 2 and has one end 33 simply resting on the primary platform. Spring 34 gives resiliency to the action of secondary platform 31. This mechanism operates in a similar manner to that described with reference to FIGS. 1 to 8.

Various modifications may be made to the mechanism without departing from the scope of the invention, for example, the design of the platforms may be other than those illustrated in FIGS. 5 to 8. The pivot of the primary platform may not be at the end of the platform but along its length.

What is claimed is:

1. A pedal mechanism for a base drum, said mechanism comprising:

a primary platform, support means coupled to said primary platform for supporting said primary platform for pivotal movement about a first axis of rotation;

a beater ball, said beater ball being moveable between an at-rest position and an operative position, said operative position being defined as that position when said beater ball is in contact with the base drum with which said mechanism cooperates;

coupling means for connecting said beater ball to said primary platform, said primary platform being moveable about said first axis to move said beater ball between said at-rest position and said operative position, and a second platform supported for pivotal movement relative to said primary platform, said secondary platform being moveable about a second axis of rotation, said second axis being generally parallel to said first axis, said secondary platform co-operating with said primary platform and forming an angle with said primary platform where said secondary platform cooperates with said primary platform, said secondary platform pivoting relative to said primary platform and about said second axis so that said co-operation between said secondary platform and said primary platform causes said primary platform to pivot about said first axis and move said beater ball from said at-rest position to said operative position whereby said beater ball moves into contact with said drum when said primary platform is urged by the sole area of the user's foot thereby causing said primary platform to pivot about said first axis or when said secondary platform is urged by the heel area of the user's foot thereby causing said secondary platform to pivot about said second axis.

2. A pedal mechanism as defined in claim 1 wherein said primary platform has a first and second end and said secondary platform has a first and second end, whereby the co-operation of said secondary platform with said primary platform is characterized by the co-operation of one of said first and second ends of said secondary platform with said primary platform generally intermediate said first and second ends of said primary platform.

3. A pedal mechanism as defined in claim 2 further including:

said support means for said primary platform pivotal movement having first pivot means, one of said first and second ends of said primary platform being coupled to said first pivot means and the other of said first and second primary platform ends being connected to said coupling means, and said support for said secondary platform pivotal movement having second pivot means, one of said first and second ends of said secondary platform being coupled to said second pivot means.

4. A pedal mechanism as defined in claim 3 wherein the co-operation of said secondary platform intermediate said first and second ends of said primary platform is further characterized in that said one of said first and second ends of said secondary platform is coupled to said primary platform.

5. A pedal mechanism as defined in claim 4 further characterized in that said one of said first and second ends of said secondary platform is coupled to said primary platform by said second pivot means.

6. A pedal mechanism as defined in claim 3 wherein the co-operation of said secondary platform intermediate said first and second ends of said primary platform is further characterized in that one of said first and second ends of said secondary platform rests on said primary platform.

7. A pedal mechanism as defined in claim 3 further including a first biasing means associated with said secondary platform for urging said secondary platform about said second axis in a direction away from said primary platform.

8. A pedal mechanism as defined in claim 4 wherein said angle between said primary and secondary platforms remains substantially constant during the movement of said beater ball between said at-rest and operative positions in response to a moving force being applied to said primary platform.

9. A pedal mechanism for a base drum, said mechanism comprising:

first pivot means having a first axis of rotation;

a primary platform having a first and second end, one of said first and second ends being coupled to said first pivot means;

a beater ball, said beater ball being moveable between an at-rest position and an operative position, said operative position being defined as that position when said beater ball is in contact with the base drum with which said mechanism cooperates;

coupling means for connecting said beater ball to the other of said first and second ends of said primary platform, said primary platform being moveable about said first pivot means to move said beater ball between said at-rest position and said operative position;

second pivot means having a second axis of rotation, said second axis being generally parallel to said first axis of rotation, and a secondary platform having a first and second end, one of said first and second ends being coupled to said second pivot means, said first end co-operating with said primary platform generally intermediate said first and second ends of said primary platform and forming an angle with said primary platform where said secondary platform co-operates with said primary platform, said secondary platform pivoting relative to said primary platform about said second pivot axis so that said first end of said secondary platform causes said primary platform to pivot about said first axis and move said beater ball from said at-rest position to said operative position whereby said beater ball moves into contact with said drum when said primary platform is urged by the sole area of a user's foot thereby causing said primary platform to pivot about said first axis or when said secondary platform is urged by the heel area of a user's foot thereby causing said secondary platform to pivot about said second axis and said primary platform to pivot about said first axis.

10. A pedal mechanism as defined in claim 9 further including a first biasing means associated with said secondary platform for urging said secondary platform about said second axis in a direction away from said primary platform.

11. A pedal mechanism as defined in claim 9 wherein said angle between said primary and secondary platforms remains substantially constant during the movement of said beater ball between said at-rest and operative positions in response to a moving force being applied to said primary platform.

12. A pedal mechanism as defined in claim 9 further including a stand having a support end and an upper end.

13. A pedal mechanism as defined in claim 12 wherein said coupling means further includes second biasing means mounted to said upper end of said stand for urging said primary platform about said first axis whereby said beater ball is caused to move from said operative position to said at-rest position.

14. A pedal mechanism as defined in claim 9 wherein the co-operation of said secondary platform intermediate said first and second ends of said primary platform is further characterized in that said secondary platform first end is pivotally coupled to said primary platform.

15. A pedal mechanism as defined in claim 9 wherein the co-operation of said secondary platform intermediate said first and second ends of said primary platform is further characterized in that said secondary platform first end freely rests on said primary platform and said second pivot means is coupled to said second end of said secondary platform.

* * * * *